United States Patent [19]

Vought et al.

[11] 4,403,879

[45] Sep. 13, 1983

[54] CARRIER LOCKING DEVICE

[75] Inventors: Kenneth D. Vought, Cortland; Steven M. Faes, Homer, both of N.Y.

[73] Assignee: SCM Corporation, New York, N.Y.

[21] Appl. No.: 261,324

[22] Filed: May 6, 1981

[51] Int. Cl.[3] ..... B41J 29/56

[52] U.S. Cl. ..... 400/674; 400/54; 400/320; 400/322

[58] Field of Search ..... 400/54, 674, 675, 279, 400/320, 322

[56] References Cited

U.S. PATENT DOCUMENTS

| | | | |
|---|---|---|---|
| 1,599,822 | 9/1926 | Kurowski | 400/674 |
| 2,568,002 | 9/1951 | Hart et al. | 400/54 |
| 3,239,051 | 3/1966 | Morris et al. | 400/674 |
| 3,719,263 | 3/1973 | Navone | 400/674 X |
| 4,114,750 | 9/1978 | Baeck et al. | 400/279 |

FOREIGN PATENT DOCUMENTS

| | | | |
|---|---|---|---|
| 3001441 | 7/1980 | Fed. Rep. of Germany | 400/54 |
| 55-74893 | 6/1980 | Japan | 400/674 |
| 55-100182 | 7/1980 | Japan | 400/54 |
| 486330 | 4/1970 | Switzerland | 400/674 |
| 720192 | 12/1954 | United Kingdom | 400/674 |
| 863543 | 3/1961 | United Kingdom | 400/54 |

OTHER PUBLICATIONS

IBM Technical Disclosure Bulletin, "Carriage-Locking Mechanism", Wilmoth, vol. 22, No. 12, May 1980, pp. 5229-5230.

*Primary Examiner*—Ernest T. Wright, Jr.

*Attorney, Agent, or Firm*—William E. Mear, III; Ernest F. Weinberger

[57] ABSTRACT

A carriage locking device is used for locking a transversely movable carrier in a typewriter to safeguard against damage when the typewriter is not in typing use, especially during shipping transport. The device includes a pair of blades operable between a released position for enabling the carrier to travel sideways and a locked position for engageably holding the carrier fast in the typewriter. A lock control linkage is coupled to the blades for allowing the operator selective movement thereof to shift the blades between the two positions. The blades move into and out of a recess on the carrier which is only allowed to occur when the carrier is stopped at a predetermined location. A sensor lever includes a latching feature that operates in response to the carrier being away from the predetermined location to block movement of the lock control linkage for maintaining the blades in the released position. An abutment fixed on the carrier moves the sensor lever to free the lock control linkage for selective movement to shift the blades into the locked position when the carrier comes to rest at the predetermined location.

24 Claims, 6 Drawing Figures

CARRIER LOCKING DEVICE

BACKGROUND OF THE INVENTION

The present invention falls in the field of locking devices in typewriters and particularly this invention relates to a carrier locking device used to render a movable print carrier fixed in a typewriter during periods when the typewriter is not in use for typing.

Modern typewriters being manufactured are increasingly of the kind having a horizontally fixed paper support platen in combination with a carrier unit which is power driven in a side to side motion traversing the platen. The carrier is usually supported by rollers or bearings to afford free and quick movement as in a gliding motion along parallel guide beams or rods. Carrier motion may be continuous or incremental and is accomplished by a motor driven system usually including a combination of tapes and pulleys or a rack and pinion gear arrangement. The carrier support and drive system in the prior art is known to be highly sensitive with respect to providing and maintaining precise control of carrier advancement, and once stopped, the carrier must be void of side play for accurately typing characters with proper spacing therebetween. This fact coupled with a high mass concentration found on most assembled carrier units are reasons for concern. For example, in the event of accidental side shock to the typewriter, which may particularly occur during shipping transport, the carrier unit together with its suspension and drive system need to be isolated from absorbing the full blunt force of a blow perpendicular to the carrier mounting arrangement. The purpose of isolating the carrier from side shock is to avoid the occurence of damaging results, such as, loss of critical carrier adjustments or even breakage of carrier support components causing the carrier to suddenly shift to one side of the typewriter out of control.

SUMMARY OF THE INVENTION

In accordance with the teaching of the present invention there is provided a carrier locking device for use in a typewriter to lock a movable carrier with a main frame structure so as to prevent it from moving when the typewriter is not in use for typing. This feature is intended to preserve carrier adjustments and to protect the carrier unit as well as its related support and drive system from damage in the event of a side shock occurence.

To accomplish this the present carrier locking device comprises a pair of interconnected movable blades pivotally mounted on the main frame for movement into and out of a recess on a traversely movable carrier. A lock control linkage comprises a pivot member having a finger extending towards a cam edge surface on one of the blades, and a selector bellcrank pivotally mounted in the typewriter and connected to the pivot member by a control link. The selector bellcrank is manually operable to an ON position wherein the finger on the pivot member is spaced from engagement with the cam edge surface thereby enabling the blades to locate in a released position away from the recess for permitting the carrier to move sideways. The selector bellcrank is manually operable to an OFF position wherein the finger engages the cam edge surface thereby locating the blades in a locked position within the recess for engageably preventing sideways movement of the carrier. In order for the blades to operatively move from their released position to the locked position, the carrier is stopped at a predetermined location along the support rail to align the recess for receiving an engaging end of each blade. In a preferred environmental embodiment containing the present invention, the carrier is conveniently moved to the predetermined location by providing known electronic devices capable of advancing and then stopping the carrier at the proper location.

The present invention further provides a pivotally mounted sensor lever interposed between the carrier and the lock control linkage for releasably blocking selective movement of the lock control linkage as determined by the location of the carrier. A latching configuration is formed on the sensor lever to operate in conjunction with the lock control linkage, so that, when the blades are released and as long as the carrier is away from the predetermined location, the latch shape prevents selective movement of the lock control linkage from the ON position to the OFF position. An abutment extends from the carrier for engageably pivoting the sensor lever thereby removing the latching relation between the sensor lever and the lock control linkage when the carrier is stopped at the predetermined location. As a result, the lock control linkage is free to be selectively moved by the operator from the ON position into the OFF position, which, in turn, moves the blades from the released position into the locked position.

OBJECTS OF THE INVENTION

It is therefore an object of the present invention to provide in a typewriter with a relatively simple and highly reliable device for locking a movable carrier to a main frame.

Another object of the present invention is to provide a carrier locking device equipped with blades, that operatively fixes a movable carrier to a main frame so that the blades isolate the carrier from absorbing the blunt force of a side shock occurence.

A further object of the present invention is to provide a carrier locking device that is selectively operable in conjunction with the carrier stopped at a predetermined location and in conjunction with a main typewriter power switch so that when electrical current is not supplied to the typewriter, such as during shipping transport, the carrier is locked.

Other objects and many of the attendant advantages of this invention will be readily appreciated as the same becomes better understood by reference to the following detailed description when considered in connection with the accompanying drawing.

DESCRIPTION OF THE DRAWING

FIG. 1 is a left front perspective view showing a carrier locking device built in accordance with the teachings of the present invention embodied in a preferred typewriter environment.

DESCRIPTION OF THE PREFERRED EMBODIMENT

Figure 7:
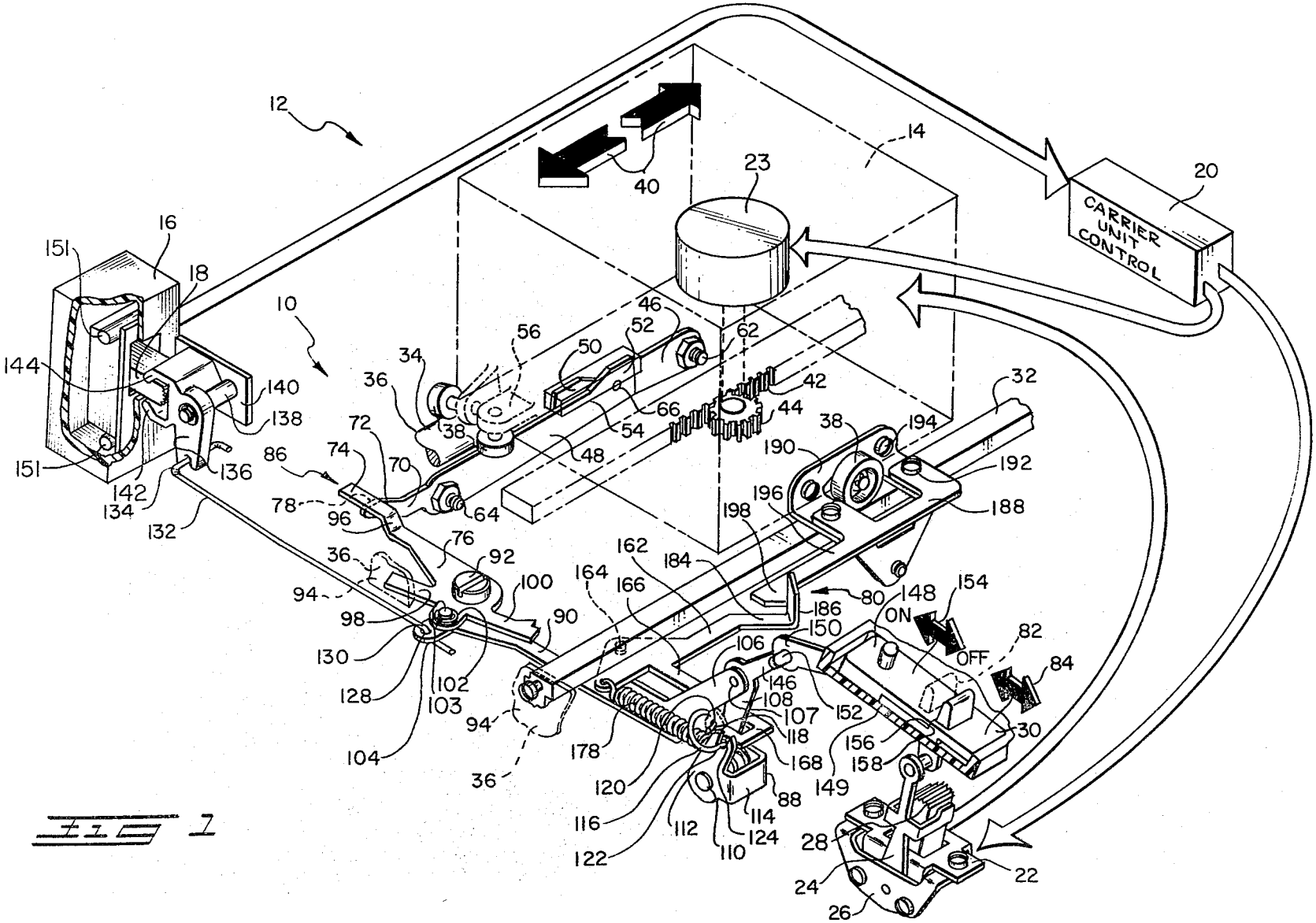

For a detailed understanding of the present invention, initial reference is made to FIG. 1 of the drawing. In this figure there is shown a carrier locking device built in accordance with the teaching of the present invention, generally denoted by overall reference numeral 10. Device 10 is assembled in a typewriter 12 of the kind employing a transversely movable carrier 14 for printing. Before discussing specific features concerning the present device 10, a brief description relating to the preferred typewriter 12 environment is included below for a better understanding of the convenient and reliable operation of the present invention. The general description of typewriter 12 is a preferred environmental embodiment and is not intended to serve as a restriction requirement applied specifically to the invention which may be utilized in other suitable forms of typewriter constructions, as will become apparent.

Typewriter 12 is an electrically powered machine which receives electric current through an actuatable main power switch 16. A main switch button 18 controls flow of current through main switch 16 to typewriter 12 and when button 18 is in a down or opened position, as is shown in FIG. 1, current is prevented from entering typewriter 12. A suitable electronically operated carrier control unit, illustrated by box 20, is connected to receive current from main switch 16 when button 18 is moved to an up or closed position. A second actuatable power switch 22 is electrically connected to receive current from carrier control unit 20 and, thereafter, selectively controls continued flow of current to a connected carrier drive motor 23 which is utilized to advance carrier 14. A selector lever 24 is pivotally mounted on a stationary bracket 26 for engageably operating to-and-fro movement of an actuator button 28 of second power switch 22. A manually movable switch slide 30 is pivotally coupled with selector lever 24 for easily enabling the operator to operatively move button 28 for controlling flow of current to carrier 14. When actuator button 28 is in a forward or open position, current flow is prevented from entering the motor 23 on carrier 14 as shown in FIG. 1 by the solid lined location of slide 30.

A front rail 32 and rear rail 34 form a fixed portion of a main structural body or frame 36 of typewriter 12. Rails 32 and 34 span typewriter 12 in parallel relation to one another for guiding sideways travel of carrier 14. Like rollers 38 support carrier 14 on rails 32 and 34 for enabling free rolling motion of carrier 14 in a side-to-side direction as indicated by arrows 40. A rack 42 is fixed with main frame structure 36 and is in mesh with a pinion gear 44 carried by carrier 14. Pinion gear 44 is rotatably turned by the carrier drive motor 23 for advancing carrier 14 along rails 32, 34. The significance of the above-described preferred environment and its relation to the teachings of the present invention is realized by the fact that with the carrier 14 stopped, side motion of carrier 14 is limited by the meshing of pinion gear 44 with rack 42. This kind of drive connection as well as others known in the art, such as, tapes and pulleys are found to be extremely sensitive and weak in the event they are exposed to a sudden side shock which is most likely to occur during shipping transport or during service maintenance. The force of the side shock, in attempting to restrain carrier 14, is directly transmitted through these weak connections which often results in damage or even a breaking loose of the carrier unit caused by the inertia of carrier 14.

With the above in mind, carrier locking device 10 according to the present disclosure is intended to protect the sensitive connection between pinion gear 44 and rack 42 coupling carrier 14 with typewriter 12 by isolating the connection from the force of a side impact. To accomplish this, device 10 comprises a pair of movable blades 46 and 48, each having an end portion 50, 52 closely received within a recess 54 formed on the underside of a metal cast body 56 of carrier 14.

Figure 2:
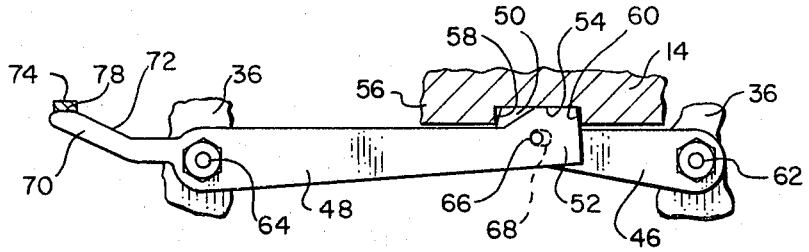
FIG. 2 is a front elevational view showing a blade portion of the present carrier locking device with the blades in a locked relation with the carrier.

As is best illustrated in FIG. 2, spaced end walls 58 and 60 of recess 54 are engageable by end portions 50 and 52. Blade 46 is shorter than blade 48 and is pivotally supported on main frame 36 at pivot mount 62 situated near the central portion of typewriter 12. Long blade 48 is also pivotally supported on main frame 36 at a pivot mount 64. Blades 46, 48 extend towards each other from their pivot mounts 62, 64 and overlap one another to terminate at end portions 50, 52, respectively. The two blades 46 and 48 are pivotally interconnected by having a pivot stud 66 on one blade, e.g., blade 48, that extends through an elongated slot 68 in the other blade 46. In this regard, driven pivot motion from one blade, e.g., 48 causes concomitant pivot motion of the other blade 46 about pivots 62, 64 in a motion somewhat resembling a scissors movement.

An arm 70 on blade 48 extends leftwardly from pivot mount 64. An upwardly angled top surface 72 of arm 70 serves as a cam surface in conjunction with a finger 74 extending from a pivot member 76 in FIG. 1 as is discussed below. A straight flat top surface 78 is a continuation of cam surface 72 and when finger 74 engageably rests on top surface 78, end portions 50, 52 of blades 46, 48 are located within recess 54 as is shown in FIG. 2. In this position, end portions 50, 52 are located in recess 54 in extremely close relation to end walls 58, 60. The close condition between end portions 50, 52 and end walls 58, 60 is controlled, via adjustment at pivot mounts 62, 64, so that no more than a few hundred thousandths of an inch (0.005 max) separate end portions 50, 52 from end walls 58, 60. This slight clearance is sufficient to allow from movement of end portions 50, 52 into and out of recess 54, yet close enough to substantially eliminate noticeable side play of carrier 14 which is normally held in position by pinion gear 44. Thus, side-to-side movement of carrier 14 is blocked by being held substantially rigid with main frame 36 via blades 46, 48 on their pivot mounts 62, 64. This position of FIG. 2 is hereinafter referred as a locked position of carrier locking device 10.

Figure 3:
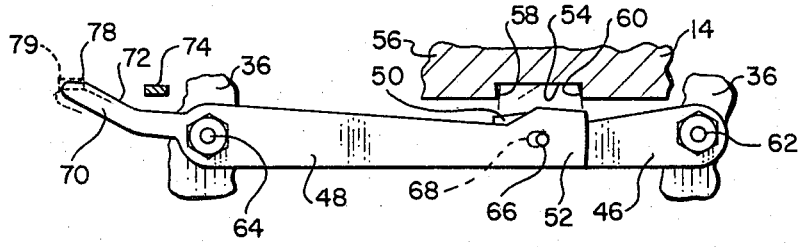
FIG. 3 is a front elevational view similar to FIG. 2 showing the blades in a released relation to the carrier and showing portions of the blades in dashed lines representing the locked relation of FIG. 2.

A released position of carrier locking device 10 is illustrated in FIG. 3 wherein portions of component parts are illustrated in the locked position by dashed lines to clearly show their moved relation. This position is a result of finger 74 being removed from engagement with arm 70 as is represented by comparing rectangular dashed box 79 in relation to the moved solid location of finger 74.

In order for end portions 50, 52 to operatively move out from and back into recess 54, as shown in the solid released position and dashed locked position in FIG. 3, carrier 14 must be stopped at a predetermined location along rails 32, 34 as determined by the relatively fixed horizontal location of end portions 50, 52 of blades 46, 48. This predetermined stopped location of carrier 14 is shown at numeral 80 in FIGS. 1, 4 and 6, wherein recess 54 is laterally aligned for receiving end portions 50, 52 from a substantially perpendicular direction when they pivotally shift upwardly about pivot mounts 62, 64.

The controlled manner utilized to move carrier 14 into the predetermined location 80 may be accomplished in many different ways including manual manipulation of carrier 14. In this regard, as important concern is convenience of use by the operator in accurately placing carrier 14 at the predetermined location 80. In the illustrated preferred environmental embodiment of FIG. 1, movement of carrier 14 into predetermined location 80 is readily accomplished utilizing known electronic control devices contained in carrier unit control box 20 and arranged in a manner capable of moving and then stopping carrier 14 at the predetermined location 80. A suitable arrangement of electronic control devices of carrier unit control 20 may be of the type disclosed, e.g., in U.S. Pat. No. 4, 114,750 entitled PRINTER SYSTEM SAVING LOCAL CONTROL FOR DYNAMICALLY ALTERABLE PRINTING. Positioning of carrier 14 to location 80 preferably occurs automatically in response to the operator moving switch slide 30 from a rearward carrier "active" position, shown by a dashed line representation at 82 in FIG. 1, in a forwardly direction indicated by arrow 84 to a forward carrier "stop" position as shown by the solid lines. As a result, actuator button 28 of second power switch 22 is moved forward by the clockwise pivotal movement of selector lever 24 thereby cutting off flow of current to carrier 14. Absence of current causes the carrier unit control 20 to use current supplied from main switch 16 to advance the carrier 14 from any location along rails 32, 34 and then stop carrier 14 at predetermined location 80. Of course if carrier 14 is already at location 80 when current is cut off, no movement takes place. It should be noted that predetermined location 80 is governed by the horizontally fixed arrangement of blades 46, 48 and may be located at any convenient location along main frame 36 by modifying the length of blades 46, 48 without departing from the invention.

With continued reference to FIG. 1, a lock control linkage 86 is provided for operating blades 46, 48 between the locked position and the released position. Lock control linkage 86 comprises pivot member 76 and a selectable bellcrank 88 coupled together by a control link 90 extending therebetween. A pivot screw 92 pivotally mounts pivot member 76 on main frame 36 adjacent a structural upright side plate 94 of frame 36. Finger 74 of pivot member 76 extends rearwardly from pivot screw 92 to terminate at a location just beyond arm 70 of blade 48. An off-set form 96 along finger 74 vertically aligns it in a relation with arm 70 so that with finger 74 engaged on flat top surface 78, end portion 52 of blade 48 is located within recess 54. A pair of opposing arms 98 and 100 on pivot member 76 serve to limit pivotal overthrow of pivot member 76 when caused to come into contact with upright side plate 94. Another arm 102 extends from pivot screw 92 in a direction towards against side plate 94. One end 104 of control link 90 is pivotally mounted at pivot stud 103 to arm 102 of pivot member 76. The other end 106 of control link 90 is formed upwardly and is pivotally connected at pivot 107 to an upstanding portion 108 of selectable bellcrank 88.

Figure 4:
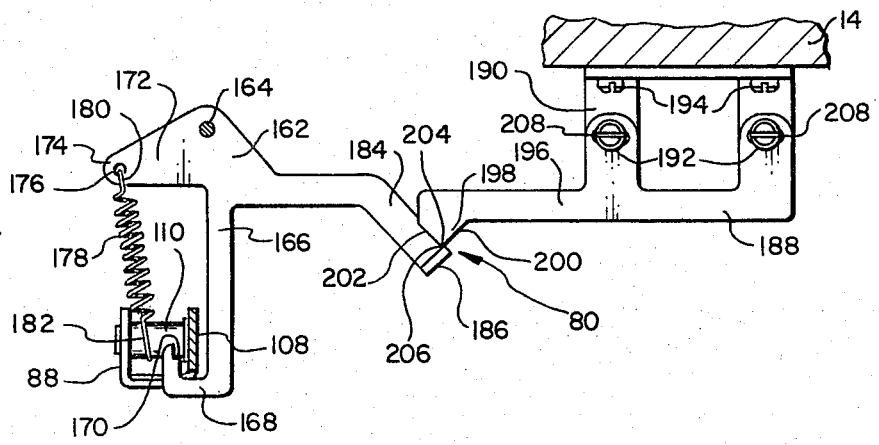
FIG. 4 is a top plan view showing a sensor lever held in an unlatched position by an abutment on the carrier while the carrier is at a predetermined location and showing a selectable member in an OFF position which locates the blades in the locked relation of FIG. 2.
Figure 5:
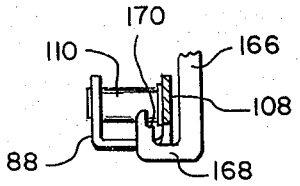
FIG. 5 is a top plan view showing a portion of the sensor lever in the unlatched position and showing the selectable member in an ON position to locate the blades in the carrier released position of FIG. 3.
Figure 6:
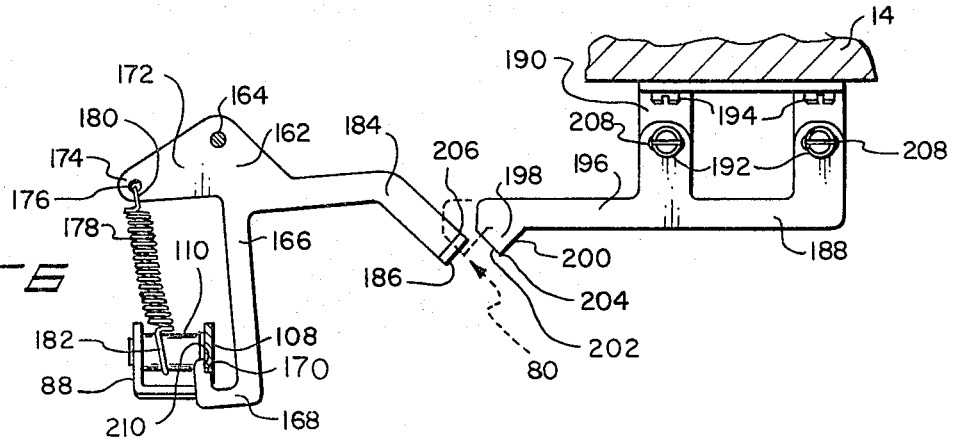
FIG. 6 is a top plan view similar to FIG. 4 showing the sensor lever in a latched position responsive to the carrier being moved away from the predetermined location and showing the selectable member blocked in the ON position.

A pivot stud 110 extends inwardly from side plate 94 for pivotally supporting selectable bellcrank 88. An arm 112 is connected to upstanding portion 108 by an integral cross brace 114 to form a U-shaped configuration of selectable bellcrank 88. A C-shaped wire spring 116 has one end 118 held stationary by extending through an aperture 120 in side plate 94. The other end 122 of C-shaped wire spring 116 is attached in a notch 124 on arm 112. C-shaped spring 116 operates as an over-center action spring for selectable bellcrank 88 when it is pivoted about pivot stud 110 between a forward OFF position, as is illustrated in FIGS. 1 and 4, and a rearward ON position, as shown in FIGS. 5 and 6.

End 104 of control link 90 extends in a direction towards side plate 94 and has an aperture 128 therethrough the attaching one end 130 of a wire link 132. The other end 134 of wire link 132 is attached to a switch actuator bellcrank 136 pivotally mounted on a stud 138 fixed on a plate 140 located near main power switch 16. A pair of clasping fingers 142 and 144 integrally extend rearwardly from switch actuator bellcrank 136. Fingers 142 and 144 are spaced apart to engageably receive switch button 18 for moving it up and down in response to switch actuator bellcrank 136 being pivoted.

An arm 146 integrally extends upwardly from upstanding portion 108 of selectable bellcrank 88. An ON-OFF slide 148 has a fixed member 150 pivotally connected with a formed ear 152 of arm 146. ON-OFF slide 148 is slidably supported by jacket structure 149 for manual sliding back and forth motion in a direction as indicated by arrow 154. A forwardmost end surface 156 of slide 148 extends to abut with a shelf 158 of switch slide 30. Through this arrangement, rearward motion applied to slide 30 causes ON-OFF slide 148 to move with it when they are together as shown and when slide 30 is in the rearward position 82, it may be moved therefrom forwardly to the illustrated solid independently from slide 148. In this regard, it can be understood that power may be cut-off from second power switch 22 to prevent current from entering carrier 14 without discontinuing current flow to other electrical units, such as carrier unit control 20, in typewriter 12 since main power switch 16 is allowed to remain ON.

Operation of the lock control linkage 86 and blades 46, 48 of carrier locking device 10 according to the present invention will now be described with reference being made to FIGS. 1–5. As previously mentioned, the solid configuration of component parts when the carrier locking device 10 is in its locked position for blocking side-to-side movement of carrier 14 is shown in FIGS. 1 and 2. Selectable bellcrank 88 is in its forward pivoted position with ON-OFF slide 148 in its OFF position. Through this configuration of parts, links 90 and 132 locate actuator bellcrank 136 with switch button 18 of main power switch 16 in its down power OFF position.

In order for carrier 14 to be freed from the hold of blades 46, 48 and subsequently allowed to travel along rails 32, 34, the operator slides ON-OFF slide 148 rearwardly from the illustrated position as is indicated by arrow 154 towards ON in FIG. 1. ON-OFF slide 148 may be moved rearwardly towards its ON position independently from switch slide 30. However, in the preferred environmental embodiment, ON-OFF slide 148 is preferably moved together with switch slide 30 through the abutting relation between shelf 158 and end surface 156. Rearward movement of ON-OFF slide 148 causes links 90 and 132 to move rearwardly in a substantially straight path which, in turn, causes switch actuator bellcrank 136 to pivot upwardly about stud 138 in a clockwise direction. Clasping finger 142 engageably moves switch button 16 upwardly from the power OFF position towards the power ON position. It should be noted, movement between power ON and power OFF positions of switch button 18 within main power switch 16 is internally stopped by known limiting structure such as spaced apart pins 151 in main power switch 16. These limit pins 151 further serve to restrict pivotal movement of selector bellcrank 88 when it is pivoted between its On and OFF position. In this regard, each arm 98 and 100 of pivot member 76 is intended to come to rest in a relation slightly spaced from contact with side plate 94 when they are swung in the direction toward side plate 94. Thus, arms 98 and 100 serve as a back-up limit for lock control linkage 86 in the event selector bellcrank 88 is caused to over pivot as a result, e.g., caused by bow bending of wire link 132. Pivot member 76 is pivoted about pivot screw 92 in a clockwise direction as a result of rearward movement of control link 90. This pivot motion causes finger 74 to move from engagement with flat top surface 78 of arm 70 of blade 48 to a location spaced from arm 70 as illustrated in FIG. 3. With the release of arm 70 from engagement with finger 74, end portions 50 and 52 fall from within recess 54 under the pull of gravity causing blades 46 and 48 to pivot downwardly about their pivot mount 62, 64, into the released position of FIG. 3. Accordingly, carrier 14 is now free to be driven sideways along rails 32 and 34 in response to carrier 14 receiving signal commands from carrier control unit 20. A convenient aspect provided by the preferred environmental embodiment arrangement of FIG. 1 resides in the fact that the operator needs only to selectively move switch slide 30 rearward in order to release blades 46 and 48 as well as allow signal commands to pass through second power switch 22 for advancing carrier 14.

From the foregoing description, blades 46 and 48 are movable between their locked position and released position by selectively moving selector bellcrank 88 between corresponding OFF and ON positions. According to the present invention selector bellcrank 88 is allowed to operatively move blades 46 and 48 when carrier 14 is in the specified predetermined location 80 with recess 54 aligned to receive end portions 50, 52 of blades 46, 48. In the event carrier 14 is spaced away from location 80, applicant provides the below described mechanism developed to releasably block movement of selector bellcrank 88 from its ON position toward its OFF position until carrier 14 is stopped at the prescribed location 80 to prevent raising of blades 46 and 48 outside recess 54.

To accomplish this, a sensor bellcrank or lever 162 is pivotally mounted on a pivot 164 for operating in conjunction with locations of carrier 14 along rails 32, 34 to discriminately determine if selector bellcrank 88 may be properly moved back to OFF to move blades 46, 48 to the locked position. As is best shown in FIGS. 4 and 6, sensor bellcrank 162 includes an arm 166 extending forwardly from pivot pin 164 toward selector bellcrank 88. A U-shaped end 168 of arm 166 has a latching configuration including a shelf 170 located proximate upstanding portion 108 (shown in cross-section in FIG. 4) of selector bellcrank 88. A side projection 172 of sensor bellcrank 162 extends from pivot 164 in a direction towards side plate 94 and terminates at an end 174 having a spring mount aperture 176 therethrough. A helical tension spring 178 has one end coil 180 hooked through aperture 176. Spring 178 is extended with its other end coil 182 attached on pivot stud 110 for continually urging sensor bellcrank 162 in a counterclockwise direction about pivot 164. An actuator arm 184 of sensor bellcrank 162 extends from pivot 164 in a direction opposing side projection 172. An end 186 of actuator arm 184 is formed at a right angle to extend upwardly.

A flat plate 188 is rigidly secured on a bracket 190 by screws 192. Bracket 190 is firmly attached on carrier 14 by screws 194. Plate 188 extends forwardly from carrier 14 and has an arm 196 extending leftwardly to terminate at a V-shaped abutment 198 formed by converging side edge surfaces 200 and 202 protruding outwardly therefrom.

Operation of the sensor bellcrank 162 portion of the present invention will now be described with detailed numeral references being made to FIGS. 4–6. The orientation of parts in FIG. 6 corresponds with the configuration of parts shown in FIG. 1. In FIG. 4, carrier 14 is at the predetermined location 80. V-shaped abutment 198 is dimensioned from carrier 14 at a location, such that, with carrier 14 stopped at location 80, a tip 204 formed where side edge surfaces 200, 202 meet is engaged with a corner 206 on formed end 186 of sensor bellcrank 162. The tip 204 and corner 206 engagement is maintained through the pull supplied by extended spring 178. Applicant realizes this precise relation between tip 204 and corner 206 may be difficult to establish without providing an adjustment feature therebetween. In this regard, a pair of mounting holes 208 receiving screws 192 are elongated in a direction parallel to the path of travel of carrier 14 as is indicated by arrows 40 in FIG. 1. Accordingly, the point to point contact relation between tip 204 and corner 206 is easily accomplished during assembly by sliding plate 188 into proper adjustment and thereafter held fixed through tightening of screws 192.

In FIG. 4, sensor bellcrank 162 is in an unlatched relation with selector bellcrank 88 with shelf 170 of U-shaped end 168 being located towards the left of upstanding projection 108 of selector bellcrank 88. In this unlatched position selector bellcrank 88 is allowed to be selectively moved between its OFF position of FIG. 4 and its ON position as is shown in partial top view FIG. 5.

As previously mentioned, with selector bellcrank 88 in the ON position of FIGS. 5 and 6, carrier 14 is free to be driven laterally along rails 32, 34. In FIG. 6, carrier 14 is located toward the right of its predetermined location 80 locating V-shaped abutment 198 away from end 186 of sensor bellcrank 162. In moving carrier 14 from location 80 in FIG. 4 to the location in FIG. 6, initial movement caused tip 204 to disengage from corner 206. Formed end 186 of actuator arm 184 engageably slides along side edge surface 202 of V-shaped abutment 198 under tension from spring 178. As a result of this action, sensor bellcrank 162 is pivoted in a counterclockwise direction about pivot 164. Further advancement of carrier 14 towards the location in FIG. 6 causes side edge surface 202 to leave formed end 186 of sensor bellcrank 162. When this occurs, sensor bellcrank 162 is pivoted into a latched relation with selector bellcrank 88 as shown in FIG. 6 wherein shelf 170 of U-shaped end 168 is located directly in front of upstanding portion 108. It can be seen that an attempt to move selector bellcrank 88 back into its OFF position is blocked by coming into contact with shelf 170. Counterclockwise pivoting motion of sensor bellcrank 162 is limited by side engagement of upstanding portion 108 with end 168 as is shown at 210 in FIG. 6. Consequently, blades 46 and 48 are prevented from moving from their released position to their locked position with carrier 14 away from predetermined location 80. Obviously, movement of carrier 14 in a direction opposite to that depicted in FIG. 6 or towards left side plate 94 from location 80, likewise will result in formed end 186 becoming disengaged with V-shaped abutment 198.

It is easily understood that when carrier 14 is returned to stop in predetermined location 80, sensor bellcrank 162 is caused to pivot clockwise when tip 204 comes into contact with corner 206. This may be accomplished as a result of carrier 14 approaching formed end 186 of sensor bellcrank 162 from either sideways direction. Sensor bellcrank 162 is pivoted against the pull of spring 178 back into the unlatched position of FIG. 5 wherein selector bellcrank 88 is now free to be selectively moved back into its OFF position for locking carrier 14.

While the present invention is shown and described herein as a single embodiment, it is obvious that numerous additions, changes and omissions may be made without departing from the spirit and scope of the invention.

What is claimed is:

1. A carrier locking device for a typewriter having a frame structure, a carrier supported for movement along the frame structure, and means for moving the carrier and capable of stopping the carrier at a predetermined location along the frame structure, the carrier locking device comprising:

a carrier locking means supported on the frame structure and with the carrier stopped in the predetermined location said carrier locking means being operable between a locked position for preventing movement of the carrier from the predetermined location and released position for enabling the carrier moving means to move the carrier away from the predetermined location;

a lock control means operatively connected to said carrier locking means and selectively movable between a first position with said carrier locking means in said locked position and a second position to permit said carrier locking means to move from said locked position to said released position; and sensor means interposed between the carrier and said lock control means and operable to conjunction with the carrier at different locations for determining selective movement of said lock control means, said sensor means operable in response to the carrier being stopped in the predetermined location to permit selective movement of said lock control means between said first and said second positions, and with said lock control means in said second position said sensor means operable in response to the carrier being away from the predetermined location to block movement of said lock control means to said first position.

2. A carrier locking device according to claim 1 wherein said frame structure includes a pair of elongated parallel rails for controlling movement of the carrier in a lateral direction, and said carrier locking means operating between said locked position and said released position moving in a perpendicular direction relative to said lateral direction.

3. A carrier locking device according to claim 1 wherein said carrier locking means comprises blade means movably mounted on the frame structure.

4. A carrier locking device according to claim 1 wherein the carrier includes a recess exposed to said carrier locking means and said carrier locking means comprises a pair of blades pivotally mounted on the frame structure for movement towards and away from said recess.

5. A carrier locking device according to claim 4 wherein said recess includes a pair of spaced walls and each one of said pair of blades includes an engaging portion, such one of said engaging portions engageable with a related one of said pair of spaced walls.

6. A carrier locking device according to claim 5 wherein said pair of blades are individually mounted on spaced apart pivots with each one of said pair of blades extending from its respective pivot in an opposite direction towards one another.

7. A carrier locking device according to claim 6 wherein said engaging portion of each one of said pair of blades is at the terminal end thereof with said pair of blades having an overlapping relation intermediate their said engaging portion and said pivot, and an interconnecting pivotal coupling joining said pair of blades together where they overlap for concomitant motion.

8. A carrier locking device according to claim 7 wherein said interconnecting pivotal coupling includes a pivot pin fixedly mounted on one of said pair of blades, an elongated slot through the other one of said pair of blades and said pivot pin closely received through said elongated slot.

9. A carrier locking device according to claim 4 wherein said pair of blades includes a camming means and said lock control means includes a movable member mounted proximate said pair of blades, said movable member operable in conjunction with said camming means for effecting movement of said pair of blades between said locked and said released positions.

10. A carrier locking device according to claiim 9 wherein said camming means includes a cam surface on one of said pair of blades and said movable member includes a finger engageable with said cam surface.

11. A carrier locking device according to claim 10 wherein said finger engaging said cam surface with said pair of blades in said locked position and said finger removed from engagement with said cam surface with said pair of blades in said released position.

12. A carrier locking device according to claim 11 wherein said member being movable between a first position with said finger removed from engagement with said cam surface and a second position with said finger engaging said cam surface and said member moving from said first position towards said second position engageably drives said pair of blades from said released position towards said locked position, and said member moving from said second position towards said first position allows said pair of blades to move under the pull of gravity from said locked position towards said released position.

13. A carrier locking device according to claim 1 wherein said lock control means comprises a linkage.

14. A carrier locking device according to claim 1 wherein said lock control means comprises:

a member pivotally mounted in the typewriter proximate said carrier locking means with a cam connection therebetween; and a selector bellcrank operatively coupled to said member, said selector bellcrank pivotally mounted in the typewriter for selective movement between an OFF position and an ON position for effecting operative movement of said carrier locking means through said cam connection.

15. A carrier locking device according to claim 14 wherein said selector bellcrank in said OFF position locates said carrier locking means in said locked position and said selector bellcrank in said ON position locates said carrier locking means in said released position.

16. A carrier locking device according to claim 1 wherein said sensor mens comprises a lever means operatively responsive to different locations of the carrier for discriminatingly enabling selective movement of said lock control means.

17. A carrier locking device according to claim 1 wherein the carrier includes an abutment fixed thereon and said sensor means comprises a lever pivotally mounted in the typewriter, said lever operable in conjunction with said abutment and extending to cooperate with said lock control means, and said lever pivotable between an unlatched position for permitting said lock control means to be selectively moved and a latched position for blocking selective movement of said lock control means.

18. A carrier locking device according to claim 17 wherein said lock control means includes a selector bellcrank pivotally mounted in the typewriter and said lever includes a first arm extending towards and engageable by said abutment and a second arm having a latch configuration cooperable with said selector bellcrank.

19. A carrier locking device according to claim 18 wherein said first arm engages said abutment when the carrier is at the predetermined location, and said first arm is removed from engagement with said abutment in response to the carrier being moved away from the predetermined location.

20. A carrier locking device according to claim 19 wherein said first arm engaging said abutment locates said lever in said unlatched position and said first arm in being removed from engagement with said abutment enabling said lever to pivot from said unlatched position toward said latched position.

21. A carrier locking device according to claim 20 further including spring means for urging said lever towards said latched position.

22. A carrier locking device according to claim 21 wherein said spring means comprises a helical tension spring.

23. A carrier locking device according to claim 1 wherein the typewriter is electrically powered and the carrier moving means includes a motor for controlling movement of the carrier, and further comprising:

a first electrical switch operable by said lock control means for selectively controlling flow of electrical current into the typewriter, said first electrical switch operable between a power ON position supplying electrical current to the typewriter with said lock control means in said second position and a power OFF position whereby supply of electrical current to the typewriter is cut off with said lock control means in said first position;

a second electrical switch interposed between said first electrical switch and the motor for selectively controlling flow of electrical current from the first electrical switch into the motor, said second electrical switch operable between an unactuated position for preventing flow of electrical current to the motor and an actuated position for permitting flow of electrical current to the motor; and slide means selectively mounted for manual movement for operating said first electrical switch and said second electrical switch.

24. A carrier locking device according to claim 23 wherein said slide means comprises:

a first slide member connected to said lock control means;

a second slide member connected to said second switch; and means interconnecting said first slide member with said second slide member for allowing independent and simultaneous movement of said first and said second slide member.

* * * * *